US010571938B2

(12) United States Patent
Wang et al.

(10) Patent No.: US 10,571,938 B2
(45) Date of Patent: Feb. 25, 2020

(54) METHOD AND APPARATUS FOR REGULATING THE VOLTAGE OF A TRANSFORMER SYSTEM

(71) Applicant: SIEMENS AKTIENGESELLSCHAFT, Munich (DE)

(72) Inventors: Yuting Wang, Berlin (DE); Frank Mieske, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/106,340

(22) Filed: Aug. 21, 2018

(65) Prior Publication Data

US 2019/0064858 A1 Feb. 28, 2019

(30) Foreign Application Priority Data

Aug. 22, 2017 (EP) ..... 17187264

(51) Int. Cl.
*G05F 1/14* (2006.01)

(52) U.S. Cl.
CPC ..... *G05F 1/14* (2013.01)

(58) Field of Classification Search
CPC ..... G05F 1/10; G05F 1/12; G05F 1/14; G05F 1/147; G05F 1/153; G05F 1/16; G05F 1/20; G05F 1/22; G05F 1/66; G05F 1/70; H02M 5/10; H02M 5/12; H02J 3/18; H02J 3/1885; H02J 3/46; H02J 3/878; H01F 29/00; H01F 29/02; H01F 29/04; H01F 29/025; H02P 13/00; H02P 13/06; Y02E 40/00; Y02E 40/30; Y02E 40/34
USPC ..... 323/205–211, 212, 215, 216, 247–264, 323/268–275, 282–285, 351; 700/286–298
See application file for complete search history.

(56) References Cited

U.S. PATENT DOCUMENTS 5,210,443 A * 5/1993 Kugler ..... G05F 1/24 307/17
8,321,162 B2 * 11/2012 Labuschagne ..... H02J 3/1878 702/60
2017/0366007 A1 * 12/2017 Abelen ..... H02J 3/1878

FOREIGN PATENT DOCUMENTS

CN 205583707 U 9/2016
EP 2482415 A1 8/2012

* cited by examiner

*Primary Examiner* — Yusef A Ahmed
*Assistant Examiner* — Carlos O Rivera-Perez
(74) *Attorney, Agent, or Firm* — Laurence Greenberg; Werner Stemer; Ralph Locher

(57) ABSTRACT

A method for controlling a value of a voltage at a conductor to which at least one secondary winding of a first steppable transformer and a secondary winding of a second steppable transformer are connected is provided. The method includes: if a voltage deviation of the voltage at the conductor from a voltage setpoint value is within a first range around the voltage setpoint value, and if an overall deviation of a sum of the voltage deviation and a reactive current deviation from the voltage setpoint value respectively for the first and the second transformer is outside of a second range, which is larger than the first, around the voltage setpoint value: setting a delay time for stepping the first transformer and/or the second transformer in such a way that stepping of the first or the second transformer that counteracts the voltage deviation is prioritized.

15 Claims, 2 Drawing Sheets

METHOD AND APPARATUS FOR REGULATING THE VOLTAGE OF A TRANSFORMER SYSTEM

CROSS-REFERENCE TO RELATED APPLICATION

This application claims the priority, under 35 U.S.C. § 119, of European application EP 17187264.1, filed Aug. 22, 2017; the prior application is herewith incorporated by reference in its entirety.

BACKGROUND OF THE INVENTION

Field of the Invention

The present invention relates to a method and an apparatus for regulating a value of a voltage at a conductor to which at least one secondary winding of a first steppable transformer and a secondary winding of a second steppable transformer are connected. The present invention further relates to a transformer system, which contains the apparatus and two steppable transformers.

It is known from the prior art that two or more transformers are connected in parallel on a busbar in order to distribute the power that is to be delivered between the transformers in order that the individual transformer does not become overloaded. However, if two or more transformers are feeding on the same busbar and the voltage regulators are regulating independently of one another at the voltage setpoint value, balancing currents can arise on account of the different open-circuit voltages of the transformers. Since the impedance of the transformers is primarily inductive, circulating reactive currents can essentially form.

Circulating reactive currents of this kind are undesired since they can lead to an increased power loss of the transformers. In addition to a voltage deviation from the voltage setpoint value, the circulating reactive current has therefore also conventionally been used as an additional regulation criterion of the voltage regulation in order to minimize said circulating reactive current.

In a conventional voltage regulator, a voltage band or a range B is defined around the voltage setpoint value. If the measured voltage is outside of this range, a stepping command is sent to a tap changer after a settable temporal delay, whereby the voltage returns back to the voltage band due to the change in the open-circuit voltage of the transformer. The setting value of the range is stipulated to be at least so great that the range is not passed through by the setpoint value during stepping up or stepping down. Otherwise, this would result in endless stepping back and forth. With the voltage regulation for parallel transformers according to the circulating reactive current method, in addition to the voltage deviation at each parallel transformer, the circulating reactive current is ascertained and a regulation deviation based on the circulating reactive current is added to the regulation deviation due to the voltage.

The regulation deviation DCC resulting from the circulating reactive current can generally be calculated according to the following formula:

$$DCC=(k*ICC*X*\text{root}(3)*100\%)/UN,$$

where k is a settable circulating reactive current regulation factor;

ICC is a circulating reactive current;

X is a transformer series reactance calculated from short-circuit voltage; and

UN is rated transformer voltage.

The overall deviation D is ascertained from the sum of the voltage deviation and the circulating reactive current deviation and is compared with the range:

$$D=DV+DCC.$$

In the case of two parallel transformers, exactly the opposite circulating reactive current and hence exactly the opposite circulating reactive current deviation $D_{CC}$ results in the case of a difference of the open-circuit voltages. If the measured voltage at both transformers corresponds to the setpoint voltage, exactly the opposite overall deviation D thus results at both voltage regulators.

For example, a first transformer A has a higher stepped level and hence a higher open-circuit voltage than a second transformer B. The circulating reactive current voltage deviation $D_{CC}$ is thus positive. In this example, according to a conventional regulation method, both regulators would perform stepping to control the transformers, since in one of the transformers the reactive current deviation is greater than the threshold value of the range and in the other transformer the reactive current deviation is lower than the negative of the threshold value of the range.

After opposite stepping of both regulators, the identical case would arise with interchanged roles. The regulators according to the prior art would subsequently step endlessly. The regulation thus conventionally operates in an unstable manner and unnecessary wear of the tap changer can be associated therewith. The regulators would subsequently step endlessly. In this case, additional measures would be required to prevent unnecessary stepping.

Voltage regulators with two different time characteristics have also been used conventionally. In the case of the linear time characteristic, regulation takes place using a constant regulation deviation independently of the regulation deviation. In the case of the inverse time characteristic, the delay time is inversely proportional to the regulation deviation D. The setting of the delay time for voltage deviations is prescribed by the network operator, in order that superordinate coordination in radial networks is possible. Fixed, different parameterization is therefore not desired. Moreover, in the case of a voltage dip due to load connection, both regulators should step after the same delay time.

In the prior art, a voltage regulator has also been proposed, in which one regulator is set to be more sensitive to the circulating reactive current than the other. However, this has the disadvantage that no regulation deviation is produced in the sensitive regulator in the case of a voltage deviation within the voltage range, since $D_V$ and $D_{CC}$ cancel each other out and in the insensitive regulator D does not exceed the range B. A poor regulating quality can thus be produced and the circulating reactive current is not corrected satisfactorily.

SUMMARY OF THE INVENTION

It is therefore an object of the present invention to provide a method and an apparatus for controlling a value of a voltage at a conductor to which at least one secondary winding of a first steppable transformer and a secondary winding of a second steppable transformer are connected, wherein reliable control is achieved, wherein wear of components, in particular wear of tap changers of transformers, is reduced.

The object is achieved by the subjects of the independent claims. The dependent claims specify particular embodiments of the present invention.

Embodiments of the present invention use temporal stepping prioritization to stabilize voltage regulation. The stabilization of the regulator is used in the sense of temporal stepping prioritization if the voltage deviation is located within a specific band of the range. The specific band of the range is also referred to in the following text as prioritization range, wherein the prioritization range is smaller than the range conventionally used.

According to one embodiment of the present invention, a method for controlling a value of a voltage at a conductor to which at least one secondary winding of a first steppable transformer and a secondary winding of a second steppable transformer are connected is provided. The method includes: if a voltage deviation of the voltage at the conductor from a voltage setpoint value is within a first range around the voltage setpoint value, and if an overall deviation of a sum of the voltage deviation and a reactive current deviation from the voltage setpoint value respectively for the first and the second transformer is outside of a second range, which is larger than the first, around the voltage setpoint value: setting a delay time for stepping the first transformer and/or the second transformer in such a way that stepping of the first or the second transformer that counteracts the voltage deviation is prioritized.

The method can be implemented partly in hardware and/or software, in particular can be implemented by a computer method. The conductor to which the secondary windings of the first and of the second transformer are connected is also referred to as a busbar.

The transformers can have tap changers of any known type. An open-circuit voltage of the respective transformer can be set by actuating the tap changers. In this case, stepping can be performed on a primary winding or also the secondary winding. Stepping that is performed on the primary stage can be advantageous since the current (in particular during load operation) can be lower than a current flowing through the secondary coil on account of the higher voltage at the primary winding.

To regulate the voltage setpoint value on the busbar (which is electrically connected to corresponding secondary windings of the transformers), steppable transformers are used, in which it is possible to tap at various points of the primary winding and/or the secondary winding. To step the transformers, what are known as tap changers can be used, which tap changers serve to set the transformation ratio. To this end, the winding or the coil of the transformer can have on the primary side and/or the secondary side a root winding and a regulating or step winding having a plurality of taps, which are guided to the tap changer. Known tap changers include what are known as on-load tap changers (OLTC) and diverters (no-load tap changers (NLTC), deenergized tap changers (DETC) or off-circuit tap changers (OCTC)). On-load tap changers can serve for arrangement-free switchover under load and can be divided into on-load selectors and on-load switches. In this case, a tap changer column can switch either one or a plurality of phases, for example three phases.

In order to measure the voltage deviation and the reactive current, a measuring apparatus can be provided, which measures both the current in the secondary windings and also in each case the current flowing from the secondary windings to the conductor. Both the voltage deviation and the reactive current deviation can in this case be specified or defined, for example, as a proportion or a percentage of the difference of the voltage setpoint value or a reactive current setpoint value from zero.

One embodiment of the present invention uses an optimized calculation of the regulation deviation resulting from the circulating reactive current:

$$DCC=(k*ICC*(X+\text{Term } A)*\text{root}(3)*100\%)/UN, \quad (2)$$

$$\text{Term } A=X/(X*BP-1) \quad (3)$$

Where:

K is a settable circulating reactive current control factor;

ICC is a circulating reactive current;

X is a transformer series reactance calculated from short-circuit voltage;

BP is an overall reactive conductance or overall susceptance of all of the parallel transformers; and UN is a rated transformer voltage.

With the addition of the term X/(X*BP−1) to the transformer reactance, the regulation sensitivity is amplified precisely so that the regulation deviation caused by the circulating reactive current DCC is exceeded in the case of a minimal step difference.

Owing to this optimization, the set value of the regulation sensitivity can be kept at the preset value of 1 in most cases and hence a very good regulation sensitivity and regulation stability are provided without costly startup. In conventional regulators, the optimum factor has to be ascertained during startup.

Embodiments of the present invention use two ranges, in particular a first range and a second range. Conventional methods use only a single range, in particular the second range. Embodiments of the present invention address regulation instability in the case in which the voltage deviation is relatively low and the reactive current deviations are opposite and of the same magnitude. For this case, conventional methods and apparatuses have continuously stepped up and down, which has led to damage and wear to components.

According to embodiments of the invention, however, a delay time is set for the case that the voltage deviation is within a first range around the voltage setpoint value. The delay time (of one of the first or the second transformer) can define how long a certain deviation has to at least be present in order to carry out stepping of the corresponding transformer. In order to prioritize the stepping of a specific transformer, the delay time of the respective other transformer can be increased. If the delay time of a certain transformer is increased, this corresponds to a stricter criterion for triggering stepping of the respective transformer. When, for example, the voltage deviation is negative, priority can be given to stepping up the transformer that exhibits a negative overall deviation (by increasing the corresponding delay time of the other transformer). A simple method for stabilizing the regulation is thus provided.

According to one embodiment of the present invention, a delay time of the transformer for which the overall deviation has a different sign to the voltage deviation is set to be greater than another delay time for the other transformer.

Priority in the case of stepping is therefore given to the transformer that has an overall deviation that has an identical sign to the voltage deviation. In this case, the stepping or the voltage step during stepping up and stepping down and the second range can be selected depending on one another so that stepping up and during stepping down the open-circuit voltage at the output of the secondary winding does not leave the second range. Continuous switching back and forth can therefore be prevented.

The method can be designed in such a way that, if the overall deviation and/or reactive current deviation is outside of the second range for at least the delay time that is set to be greater, the corresponding transformer is stepped up if the overall deviation is negative and is stepped down if the overall deviation is negative, wherein the stepping is left if the overall deviation is outside of the second range for a shorter time than the delay time that is set to be greater.

A given transformer is then only stepped up or stepped down when the corresponding or respective overall deviation is outside of the second range for a period, which period is at least as great for the presently set delay time. By changing the delay time a criterion can thus be changed, according to which stepping takes place.

According to one embodiment of the present invention, the method is configured in such a way that, when stepping up one of the transformers, a higher voltage and, when stepping down one of the transformers, a lower voltage is present at the output of the secondary winding of the respective transformer, wherein the stepping up and/or the stepping down take(s) place by appropriate tapping at a respective primary winding (and/or secondary winding), the input of which is connected to a further conductor, at which, in particular, a high voltage between 70 kV and 400 kV is present, wherein the voltage setpoint value is, in particular, between 5 kV and 20 kV.

Stepping down and stepping up can be achieved by changing the tapping at the primary winding and/or at the secondary winding.

According to one embodiment of the present invention, the delay time that is set to be greater is between 1.5 and 2.5 times, particularly 2 times, the other delay time. Effective stabilization of the regulation can thus be achieved.

According to one embodiment of the present invention, the overall deviation for the other transformer (the delay time of which is not increased) has an identical sign to the voltage deviation. The other transformer is prioritized in terms of stepping in order to counteract the voltage deviation.

According to one embodiment of the present invention, the method is configured in such a way that, when the voltage deviation is negative, the delay time for the voltage regulator or regulators, which exceed the range, that is to say step down, is set to be greater. This holds true in the case of:

$$DV<=0$$

$$-BCC_DV<DV<BCC_DV$$

$$=DCC,D>B$$

wherein the first range is given by the band [−BCC_DV, BCC_DV];

the second range is given by the band [−B, B];

DV is the voltage deviation;

DCC is the reactive current deviation;

D is the overall deviation;

for example, the delay time that is set to be greater can be between 1.5 and 2.5 times, particularly 2 times, the other delay time.

According to one embodiment of the present invention, the method is configured in such a way that, when the voltage deviation is positive, the delay time for the voltage regulators, which undershoot the range, that is to say step up, is set to be greater. This holds true in the case of:

$$D_V>0$$

$$-BCC_DV<Dv<BCC_DV$$

$$DCC,D<-B.$$

According to one embodiment of the present invention, the first range is between 0.3 and 0.7 times, particularly 0.5 times, the second range. Other values are possible.

It should be understood that features, which are described, explained or provided individually or in any combination in connection with a method for controlling a value of a voltage at a conductor, can be used just as well individually or in any combination for an apparatus for controlling a value of a voltage at a conductor, according to an embodiment of the present invention, or vice versa.

According to one embodiment of the present invention, an apparatus for controlling a value of a voltage at a conductor to which at least one secondary winding of a first steppable transformer and a secondary winding of a second steppable transformer are connected is provided. The apparatus contains: a logic unit, which is configured, if a voltage deviation of the voltage at the conductor from a voltage setpoint value is within a first range around the voltage setpoint value, and if an overall deviation of a sum of the voltage deviation and a reactive current deviation from the voltage setpoint value respectively for the first and the second transformer is outside of a second range, which is larger than the first, around the voltage setpoint value, to set a delay time for stepping the first transformer and/or the second transformer in such a way that stepping of the first or the second transformer that counteracts the voltage deviation is prioritized.

The apparatus can further contain a measuring apparatus for measuring the value of the voltage and values of a reactive current of the first transformer and of the second transformer.

According to one embodiment of the present invention, a transformer system is provided, having: a first steppable transformer and a second steppable transformer connected in parallel therewith; and an apparatus for controlling a value of a voltage according to one of the embodiments described above.

In the transformer system, at least one of the first and the second transformer can have an on-load tap changer.

Other features which are considered as characteristic for the invention are set forth in the appended claims.

Although the invention is illustrated and described herein as embodied in a method and an apparatus for regulating the voltage of a transformer system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
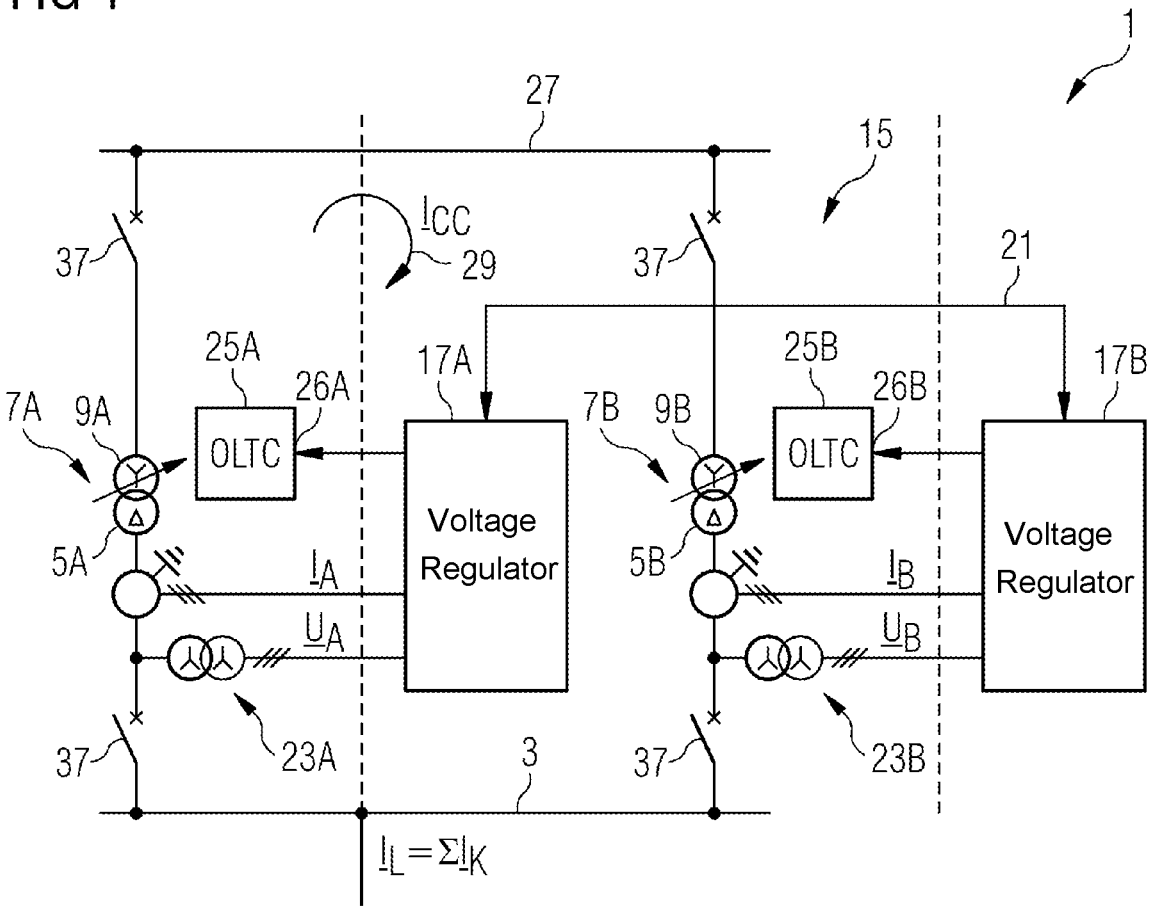
FIG. 1 is a block diagram schematically illustrating a transformer system having an apparatus for controlling a value of a voltage at a conductor in accordance with one embodiment of the present invention.

Referring now to the figures of the drawings in detail and first, particularly to FIG. 1 thereof, there is shown schematically a transformer system 1 for controlling a value of a voltage at a conductor 3 to which at least one secondary winding 5A of a first steppable transformer 7A and a secondary winding 5B of a second steppable transformer 7B are connected, in accordance with one embodiment of the present invention. The transformer system 1 schematically illustrated in FIG. 1 has the first steppable transformer 7A and the second steppable transformer 7B connected in parallel therewith, and an apparatus 13 for controlling a value of a voltage at the conductor 3.

The apparatus 13 has a logic unit 15, which is formed in the illustrated exemplary embodiment by a first voltage regulator 17A and a second voltage regulator 17B, which voltage regulators are connected to one another by a communication line 21. The logic unit 15 is configured, if a voltage deviation $D_V$ of the voltage at the conductor from a voltage setpoint value is within a first range [$-B_{CC_DV}$, $B_{CC_DV}$] around the voltage setpoint value, and if an overall deviation D of a sum of the voltage deviation $D_V$ and a reactive current deviation $D_{CC}$ from the voltage setpoint value respectively for the first and the second transformer is outside of a second range [−B, B], which is larger than the first, around the voltage setpoint value, to set a delay time T1 for stepping the first transformer 7A and/or the second transformer 7B in such a way that stepping of the first or the second transformer that counteracts the voltage deviation is prioritized.

In particular, the logic unit 15 is configured to execute a method for controlling a value of a voltage in the conductor 3 to which the at least one secondary winding 5A of the first steppable transformer 7A and the secondary winding 5B of the second steppable transformer 7B are connected, in accordance with one embodiment of the present invention.

The first transformer 7A has the first primary winding 9A and the second transformer 7B has the second primary winding 9B. Furthermore, switches 37 are provided between a high-voltage rail 27 and the busbar or conductor 3 in order to selectively isolate the first and/or the second transformer 7A, 7B from the high-voltage rail 27 and/or from the busbar 3.

In the illustrated embodiment, the apparatus 13 also contains a measuring apparatus, which is formed by partial measuring apparatuses 23A and 23B, wherein the measuring apparatus 23A is available communicatively with the first voltage regulator 17A in order to measure a first (reactive) current $I_A$ and a first open-circuit voltage or load voltage $U_A$ at the outputs of the secondary winding 5 of the first transformer 7A. The partial measuring apparatus 23B is communicatively connected to the second voltage regulator 17B and is configured to measure the reactive current $I_B$ or generally the current $I_B$ and the output voltage $U_B$ at the output connection of the second secondary winding 5B of the second transformer 7B and to feed the measurements to the second voltage regulator 17B.

To step the first transformer 7A, a tap changer 25A is provided, which receives control signals 26A from the first voltage regulator 17A, whereupon corresponding stepping (tapping at the primary winding 9A or at the secondary winding 5A of the first transformer 7A) is carried out. To step the second transformer 7B, a further tap changer 25B is provided, which receives control signals 26B from the second voltage regulator 17B, whereupon it performs desired stepping at the second transformer 7B.

The two transformers 7A and 7B are electrically connected in parallel with one another between a high-voltage rail 27 and the conductor 3 (also referred to as busbar). If the two transformers 7A and 7B have different open-circuit voltages (or else voltages under load), this can lead to a circulating reactive current 29 ($I_{KBS}$), which is undesired and is eliminated according to an embodiment of the present invention.

Embodiments of the present invention achieve stabilization of the regulation to a voltage setpoint value on the busbar 3, in particular, in the case in which the output voltages of the two transformers 7A and 7B are slightly different but are close to the voltage setpoint value.

In the following text, a prioritization range $B_{CC_DV}$ is established as $B_{CC_DV}$=factor·B, wherein the factor can be, for example, 0.5 and B is a conventionally used range. In the two transformers 7A and 7B having approximately the same transformer reactance and $D_V$=0, a step difference produces exactly the opposite circulating reactive current voltage deviation $D_{CC}$ and hence an overall deviation D. The voltage deviation $D_V$ is then in A close to 0 and hence within the prioritization range (also referred to as the first range). In the case of $D_V \leq 0$, the stepping up is temporally prioritized. That is to say that in the regulator in the transformer A (transformer 7A), where a positive circulating reactive current is measured, the doubled delay time is applied (criterion D>B). In the case of $D_V 0$, the stepping down is accordingly prioritized.

Figure 2:
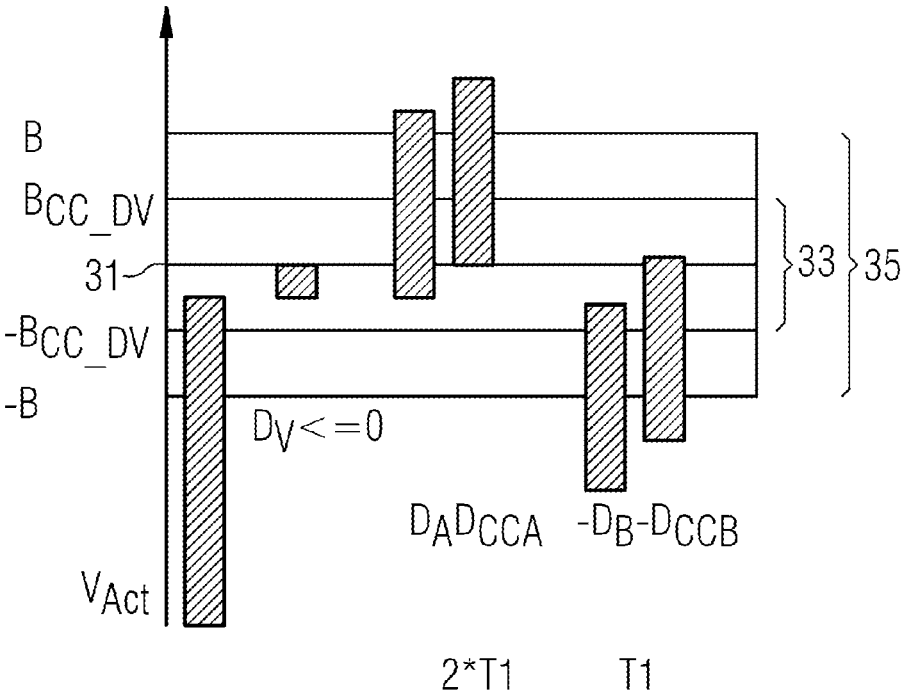
FIGS. 2 and 3 are bar charts illustrating deviations that are observed in embodiments of the present invention.

FIG. 2 schematically illustrates a bar chart, wherein the voltage deviation $D_V$, the overall deviation $D_A$ for the first transformer 7A, the reactive current deviation $D_{CCA}$ for the first transformer 7A, the overall deviation $D_B$ for the second transformer 7B and the reactive current deviation $D_{CCB}$ for the second transformer 7B are plotted. The deviations are in this case plotted relative to the setpoint voltage 31 plotted as a proportion. As can be seen from FIG. 2, the voltage deviation $D_V$ is within the first range 33 and is negative. Furthermore, $D_A$ and also $D_{CCA}$ are outside of the second range 35 and, in particular, are greater than B. Furthermore, $D_B$ and $D_{CCB}$ are outside of the second range 35 and are, in particular, >−B.

In this case, the first delay time (the delay time of the regulation for the first transformer 7A) is increased, in particular is set to double the value of the value of the delay time that is used for the second transformer 7B. Stepping up of the second transformer 7B is thus prioritized. VACT illustrates the voltage actually measured at the busbar, wherein the difference $D_V$ exists from the voltage setpoint value.

Figure 3:
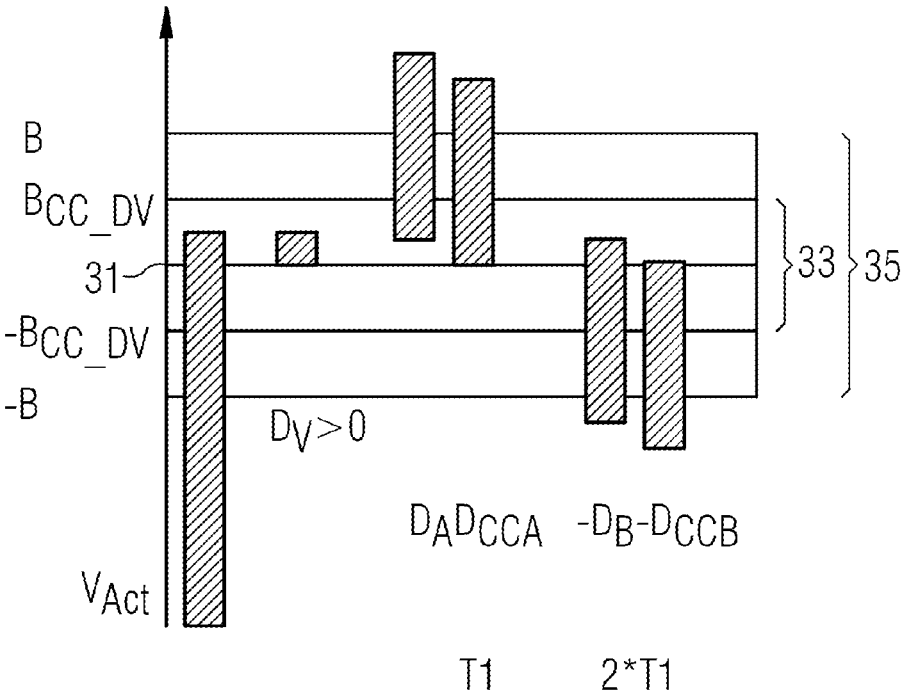

FIG. 3 illustrates, in a similar bar chart to in FIG. 2, a situation during a regulation method, wherein other values of the different deviations are present. In particular, the voltage deviation $D_V$ is within the first range 33 and at the same time is greater than 0 (>0). Furthermore, the overall deviation and the reactive current deviation of the first transformer and of the second transformer are also outside of the second range 35. In this case, the delay time for the control of the second transformer 7B is increased, in particular is set to double the value compared to the value T1 of the delay time that is used for the first transformer 7A. Stepping down of the first transformer 7A is thus prioritized.

Embodiments of the present invention can ensure regulation stability for the user, in the case of reliable dimensioning of the circulating reactive current or elimination of the circulating reactive current. The set value introduced from the prior art is therefore insufficient and can be managed poorly by the user. Owing to the low conventional regulating quality and circulating reactive current associated therewith, the power loss of the transformers is increased and hence the efficiency is decreased.

The stability achieved by embodiments of the invention simultaneously prevents unnecessary stepping and hence the lifetime of the on-load tap changers (OLTC) is increased. Costs for the network operator can thus be reduced.

The delay time T1 can be prescribed by the network operator and can relate to the elimination of voltage fluctuations in the network. The doubling of the delay time relates to the elimination of the circulating reactive current and therefore has no effect on the coordination of voltage regulation processes in radial networks.

The invention claimed is:

1. A method for controlling a value of a voltage at a conductor to which at least one secondary winding of a first steppable transformer and a secondary winding of a second steppable transformer are connected, which method comprises the steps of:

if a voltage deviation of the voltage at the conductor from a voltage setpoint value is within a first range around the voltage setpoint value, and if an overall deviation of a sum of the voltage deviation and a reactive current voltage deviation from the voltage setpoint value respectively for the first and the second steppable transformer is outside of a second range, which is larger than the first range, around the voltage setpoint value:

setting a delay time for stepping the first steppable transformer and/or the second steppable transformer in such a way that stepping of the first or the second steppable transformer that counteracts the voltage deviation is prioritized.

2. The method according to claim 1, wherein the delay time of the first or the second steppable transformer for which the overall deviation has a different sign to the voltage deviation is set to be greater than another delay time for the other of the first or the second steppable transformer.

3. The method according to claim 2, wherein:

if the overall deviation and/or the reactive current voltage deviation for at least the delay time that is set to be greater is outside of the second range, the first or second steppable transformer is stepped up if the overall deviation is negative and is stepped down if the overall deviation is positive, and wherein the stepping is left if the overall deviation is outside of the second range for a shorter time than the delay time that is set to be greater.

4. The method according to claim 2, wherein the delay time that is set to be greater is between 1.5 and 2.5 times the another delay time.

5. The method according to claim 2, wherein when the voltage deviation is negative, the delay time for a voltage regulator or regulators, which exceed the second range, that is to say step down, is set to be greater if the following holds true:

$$DV<=0,$$

$$-BCC_DV<DV<BCC_DV,$$

$$DCC,D>B$$

wherein the first range is given by the band [−BCC_DV, BCC_DV], the second range is given by the band [−B, B], DV is the voltage deviation, DCC is the reactive current voltage deviation, D is the overall deviation, wherein the delay time that is set to be greater is between 1.5 and 2.5 times the other delay time.

6. The method according to claim 5, wherein when the voltage deviation is positive, the delay time for the voltage regulator or the regulators, which undershoot the second range, that is to say step up, is set to be greater if the following holds true:

$$Dv>0$$

$$-BCC_DV<Dv<BCC_DV$$

$$D_{CC}D<-B.$$

7. The method according to claim 6, wherein the first range −BCC_DV, BCC_DV is between 0.3 and 0.7 times the second range −B, B.

8. The method according to claim 6, wherein the first range −BCC_DV, BCC_DV is 0.5 times the second range −B, B.

9. The method according to claim 5, which further comprises optimizing a calculation of the reactive current voltage deviation $D_{CC}$ resulting from a circulating reactive current in accordance with:

$$DCC=(k*ICC*(X+\text{Term } A)*\text{root}(3)*100\%)/UN,$$

wherein $$\text{Term } A=X/(X*BP-1),$$

k is a settable circulating reactive current control factor,

ICC is the circulating reactive current,

X is a transformer series reactance calculated from short-circuit voltage,

BP is the overall reactive conductance or overall susceptance of all of the parallel transformers, and UN is a rated transformer voltage.

10. The method according to claim 2, wherein the delay time that is set to be greater is 2 times the another delay time.

11. The method according to claim 1, wherein:

when stepping up one of the first and second steppable transformers, a higher voltage and, when stepping down one of the first and second steppable transformers, a lower voltage is present at an output of the secondary winding of a respective steppable transformer, wherein the stepping up and/or the stepping down takes place by appropriate tapping at a respective primary winding, an input of which is connected to a further conductor, at which, the high voltage between 70 kV and 300 kV is present; and the voltage setpoint value is between 5 kV and 20 kV.

12. The method according to claim 1, wherein the overall deviation for the other of the first or the second steppable transformer has an identical sign to the voltage deviation.

13. An apparatus for controlling a value of a voltage at a conductor to which at least one secondary winding of a first steppable transformer and a secondary winding of a second steppable transformer are connected, the apparatus comprising:

a logic unit configured such that:

if a voltage deviation of the voltage at the conductor from a voltage setpoint value is within a first range around the voltage setpoint value; and if an overall deviation of a sum of the voltage deviation and a reactive current voltage deviation from the voltage setpoint value respectively for the first and the second steppable transformer is outside of a second range, which is larger than the first range, around the voltage setpoint value;

to set a delay time for stepping the first steppable transformer and/or the second steppable transformer in such a way that stepping of the first or the second steppable transformer that counteracts the voltage deviation is prioritized.

14. The apparatus according to claim 13, further comprising a measuring apparatus for measuring the value of the voltage and values of a reactive current of the first steppable transformer and of the second steppable transformer.

15. A transformer system, comprising:

a first steppable transformer;

a second steppable transformer connected in parallel with said first steppable transformer; and an apparatus for controlling a value of a voltage, said apparatus having a logic unit configured such that:

if a voltage deviation of the voltage at a conductor from a voltage setpoint value is within a first range around the voltage setpoint value; and if an overall deviation of a sum of the voltage deviation and a reactive current voltage deviation from the voltage setpoint value respectively for said first and said second steppable transformer is outside of a second range, which is larger than the first range, around the voltage setpoint value;

to set a delay time for stepping said first steppable transformer and/or said second steppable transformer in such a way that stepping of said first or said second steppable transformer that counteracts the voltage deviation is prioritized.

* * * * *